US008777653B2

(12) United States Patent
Lo

(10) Patent No.: US 8,777,653 B2
(45) Date of Patent: Jul. 15, 2014

(54) LOCKING ASSEMBLY IN ELECTRONIC DEVICE

(71) Applicant: Hon Hai Precision Industry Co., Ltd., New Taipei (TW)

(72) Inventor: Hsin-Tien Lo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 7 days.

(21) Appl. No.: 13/669,471

(22) Filed: Nov. 6, 2012

(65) Prior Publication Data

US 2013/0122734 A1 May 16, 2013

(30) Foreign Application Priority Data

Nov. 14, 2011 (TW) ..... 100221469 U

(51) Int. Cl.
*H01R 13/62* (2006.01)

(52) U.S. Cl.
USPC ..... 439/369

(58) Field of Classification Search
USPC ..... 70/57, 58; 439/369, 445, 133
See application file for complete search history.

(56) References Cited

U.S. PATENT DOCUMENTS 4,445,738 A * 5/1984 Wiencke ..... 439/133
4,812,131 A * 3/1989 Sieverman ..... 439/134
5,192,225 A * 3/1993 Suzuki ..... 439/352
6,367,293 B1 * 4/2002 Elliott ..... 70/57
6,491,542 B1 * 12/2002 Zerebilov ..... 439/352
6,514,099 B2 * 2/2003 Endo ..... 439/357
6,902,421 B1 * 6/2005 Huang ..... 439/372
7,164,081 B1 * 1/2007 Tollefson ..... 439/652
7,892,012 B1 * 2/2011 Foung ..... 439/352
8,616,914 B2 * 12/2013 Mumper et al. ..... 439/489
2002/0019175 A1 * 2/2002 Higuchi et al. ..... 439/680
2003/0224637 A1 * 12/2003 Ling ..... 439/133
2004/0127083 A1 * 7/2004 Issa ..... 439/304
2004/0157498 A1 * 8/2004 Hall et al. ..... 439/680
2005/0090133 A1 * 4/2005 Ma ..... 439/131
2008/0045069 A1 * 2/2008 Haren ..... 439/352
2008/0299824 A1 * 12/2008 Legg ..... 439/595
2009/0280674 A1 * 11/2009 Eppright et al. ..... 439/373
2011/0305422 A1 * 12/2011 Thompson et al. ..... 439/345
2012/0260698 A1 * 10/2012 Allen et al. ..... 70/58
2013/0230993 A1 * 9/2013 Hackett et al. ..... 439/148

* cited by examiner

*Primary Examiner* — Briggitte R Hammond
(74) *Attorney, Agent, or Firm* — Novak Druce Connolly Bove + Quigg LLP

(57) ABSTRACT

An electronic device includes a case, a plug and a locking assembly. The plug is inserted into the socket on the sidewall of the case and the locking assembly includes a locking portion seat and a locking portion. The locking portion seat mounted to the receiving hole of the sidewall of the case includes a base and a hollow locking portion sleeve, the locking portion sleeve extends from the base and is received in the receiving hole of the case. The locking portion includes a securing arm, a loop and a clasp, the securing arm is inserted into the through hole to connect the locking portion and the locking portion seat, a hook at the free end of the loop is latched after the plug is collared in the loop.

8 Claims, 6 Drawing Sheets

LOCKING ASSEMBLY IN ELECTRONIC DEVICE

BACKGROUND

1. Technical Field

The disclosure relates to electronic devices, and more particularly to a locking assembly of an electronic device.

2. Description of Related Art

Many electronic devices include a power port, where a power plug inserts into the power port and supplies power to the electronic device. However, the electronic device may have no locking structure to lock the power plug to the power port, thus disengagement of the power plug from the power port may take place when an unexpected pull of the power plug occurs, and a sudden shutdown of the electronic device may result.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
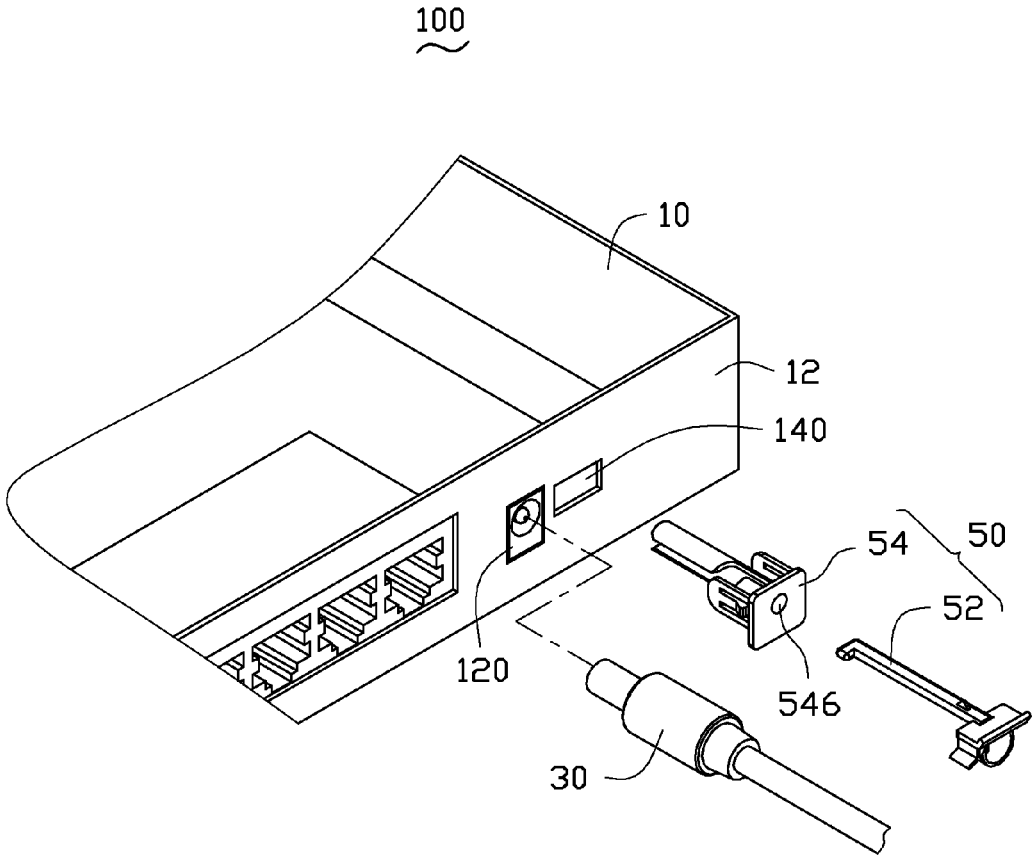
FIG. 1 is a disassembled perspective view of an electronic device with locking assembly in accordance with one exemplary embodiment of the disclosure.

FIG. 1 is a disassembled perspective view of an electronic device 100 in accordance with one exemplary embodiment of the disclosure. The electronic device 100 includes a case 10, a plug 30, and a locking assembly 50.

The case 10 accommodates electronic components, such as electronic cards, chipsets, or connectors. Although the illustrated embodiment shows the case 10 being substantially rectangular in shape, other configurations, shapes, or structures may be utilized. In this exemplary embodiment, the case 10 includes a sidewall 12. The sidewall 12 includes an socket 120 and defines a receiving hole 140. The socket 120 is adjacent to the receiving hole 140.

The plug 30 is inserted into the socket 120. In this exemplary embodiment, the plug 30 is a electrical power plug and supplies power to the electronic device 100. The plug 30 is not limited to being a power plug, and other types of plugs may be utilized.

Figure 2:
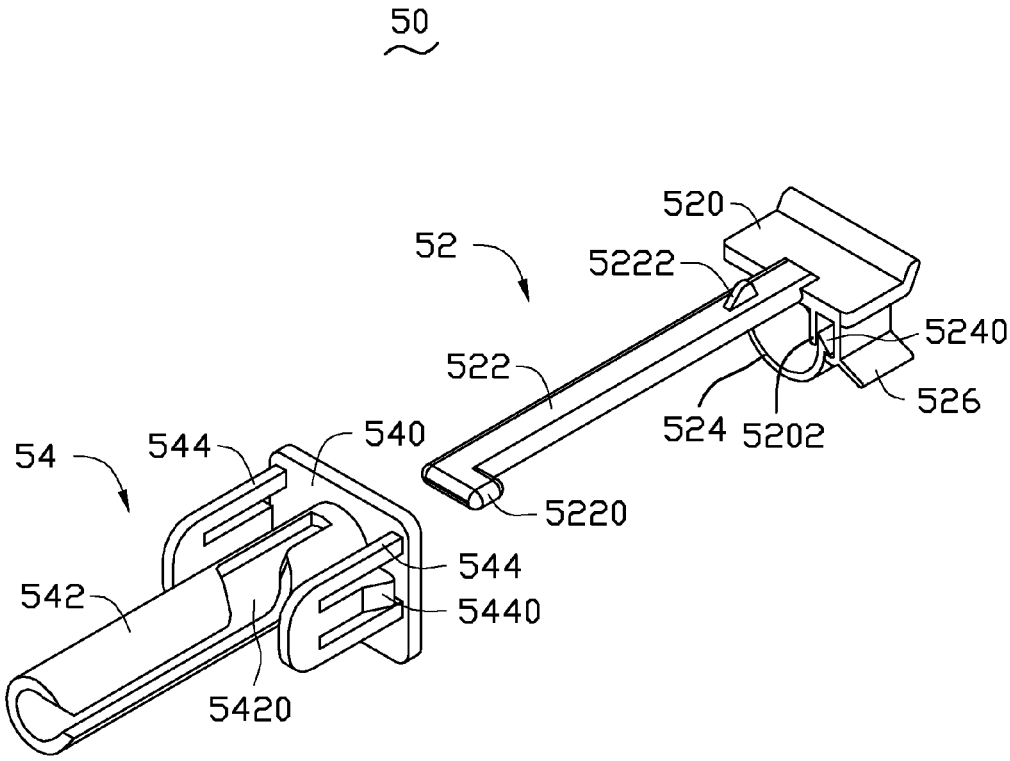
FIG. 2 is an enlarged, disassembled perspective view of the locking assembly of the electronic device in FIG. 1.
Figure 3:
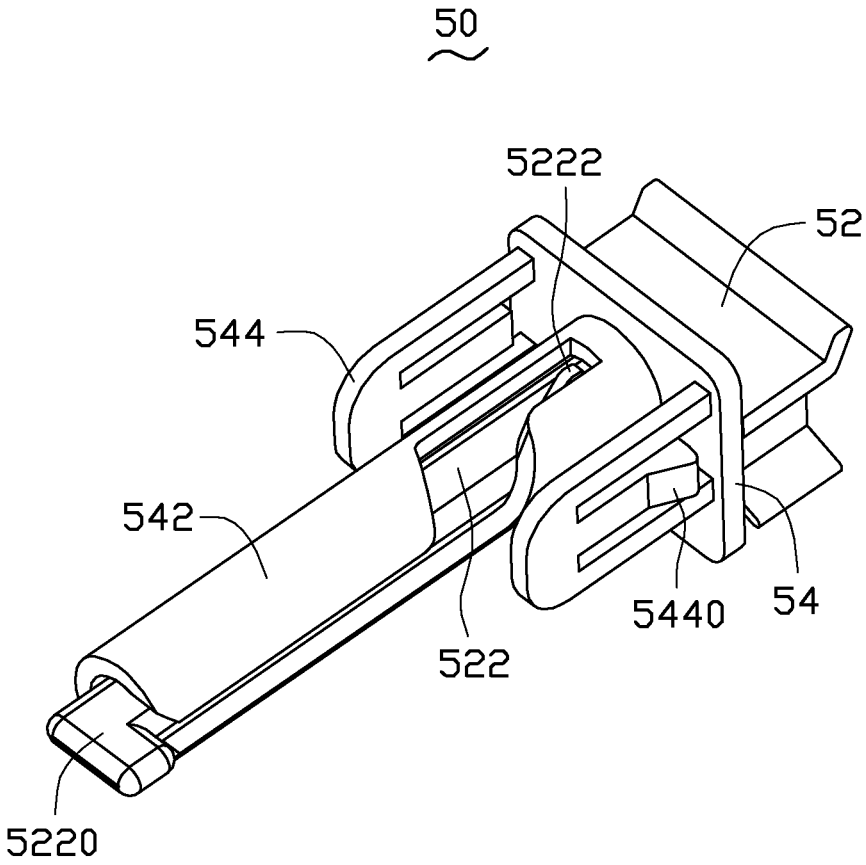
FIG. 3 is an assembled perspective view of the locking assembly of FIG. 2.

In FIG. 2 and FIG. 3, the locking assembly 50 is received in the receiving hole 140 to secure the plug 30 in the socket 120. The locking assembly 50 includes a locking portion 52 and a locking portion seat 54.

In this embodiment, the locking portion 52 is made of soft and elastic material such as nylon.

The locking portion 52 locks the plug 30 in place and includes a main body 520, a securing arm 522, a loop 524, and a clasp 526. The main body 520 includes a stopper portion 5202 located inside of the clasp 526.

The securing arm 522 facilitates the mounting of the locking portion 52 into the locking portion seat 54 and is substantially L-shaped. The securing arm 522 extends from the main body 520 into and through the locking portion seat 54. The securing arm 522 and the main body 520 collectively form a T-shape structure. The securing arm 522 includes a first hook 5220 located in the distal end of the securing arm 522 and a flange portion 5222 adjacent to the main body 520.

The loop 524 and the clasp 526 are located on the main body 520. The loop 524 is substantially annular in shape and extends out from the main body 520 and back to the clasp 526. An end of the loop 524 comprises a second hook 5240.

When the locking portion 52 is in use, the loop 524 forms a collar or belt around the plug 30. The clasp 526 locks the second hook 5240 to clasp the plug 30 in place.

The stopper portion 5202 prevents the second hook 5240 from moving as the stopper portion 5202 locates inside of the clasp 526 when the clasp 526 latches the second hook 5240, which prevents disengagement of the second hook 5240 from the clasp 526.

The locking portion seat 54 is a mounting for the locking assembly 50 on the sidewall 12 of the case 10. The locking portion seat 54 comprises a base 540, a locking portion sleeve 542, and a pair of buckle portions 544, and defines a through hole 546 (shown in FIG. 1). The locking portion sleeve 542 and the pair of buckle portions 544 extend from the underside of the locking portion seat 54. In the embodiment, a buckle portion 544 is located on each side of the locking portion sleeve 542.

The locking portion sleeve 542 is received in the receiving hole 140 to locate the locking portion seat 54 in the case 10. The locking portion sleeve 542 defines a slot 5420 communicating with the through hole 546. The slot 5420 extends from the end of the locking portion sleeve 542 which joins the base 540 towards the other end of the locking portion sleeve 542 in a non-straight line. In another embodiment, the slot 5420 extends the length of the locking portion sleeve 542 in a straight line. The first hook 5220 of the locking portion 52 can move along the slot 5420 towards or away from the locking portion sleeve 542 of the locking portion seat 54.

Each of the buckle portions 544 includes a flexible third hook 5440. In assembly, the pair of the buckle portions 544 pass through the receiving hole 140, and the third hook 5440 is slightly deformed against the inside of the sidewall 12 to then latches the locking portion seat 54 to the case 10.

The through hole 546 runs through the locking portion seat 54 and the locking portion sleeve 542, and the securing arm 522 is inserted in the through hole 546 to fasten the locking portion 52.

Figure 6:
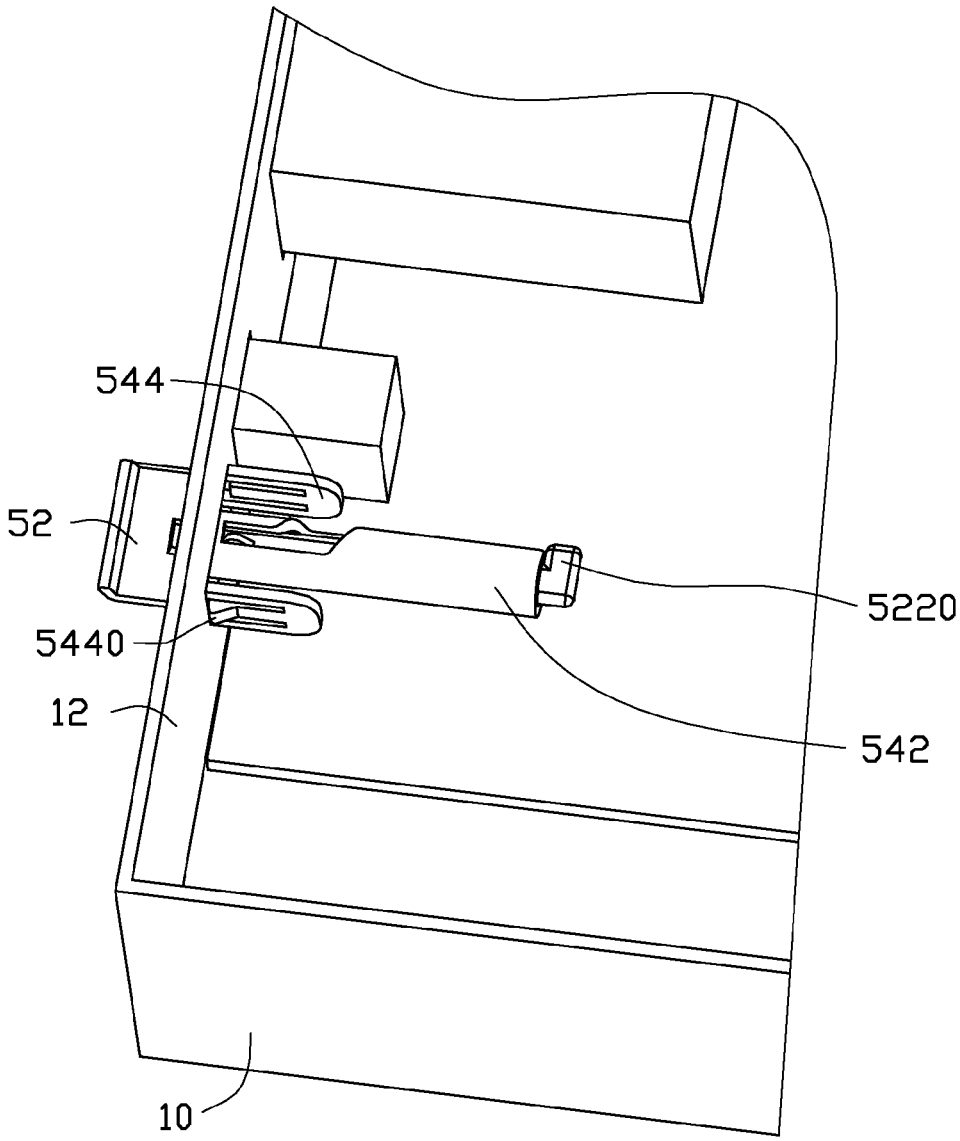
FIG. 6 is an assembled perspective view of the locking assembly and casing of the electronic device in FIG. 1.

In FIG. 3 and FIG. 6, in assembly, the securing arm 522 is inserted into the through hole 546 and the first hook 5220 passes through the locking portion sleeve 542, the locking portion 52 and the locking portion seat 54 are assembled in the locking assembly 50. The locking portion sleeve 542 and the pair of buckle portions 544 pass through the receiving hole 140 and the third hook 5440 latches against the inside of the sidewall 12, the locking assembly 50, the plug 30, and the case 10 are thus assembled in the electronic device 100.

Figure 4:
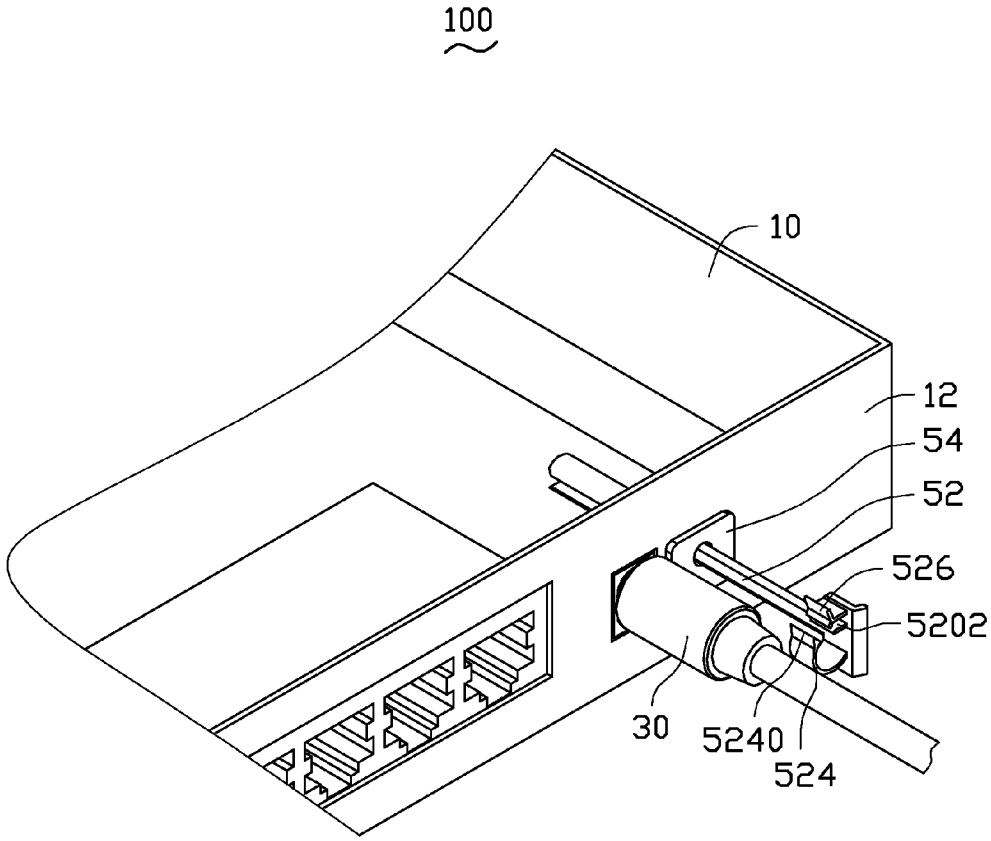
FIG. 4 is an assembled perspective view of the electronic device with locking assembly of FIG. 1, where a plug of the electronic device in FIG. 1 is in an unlocked position.
Figure 5:
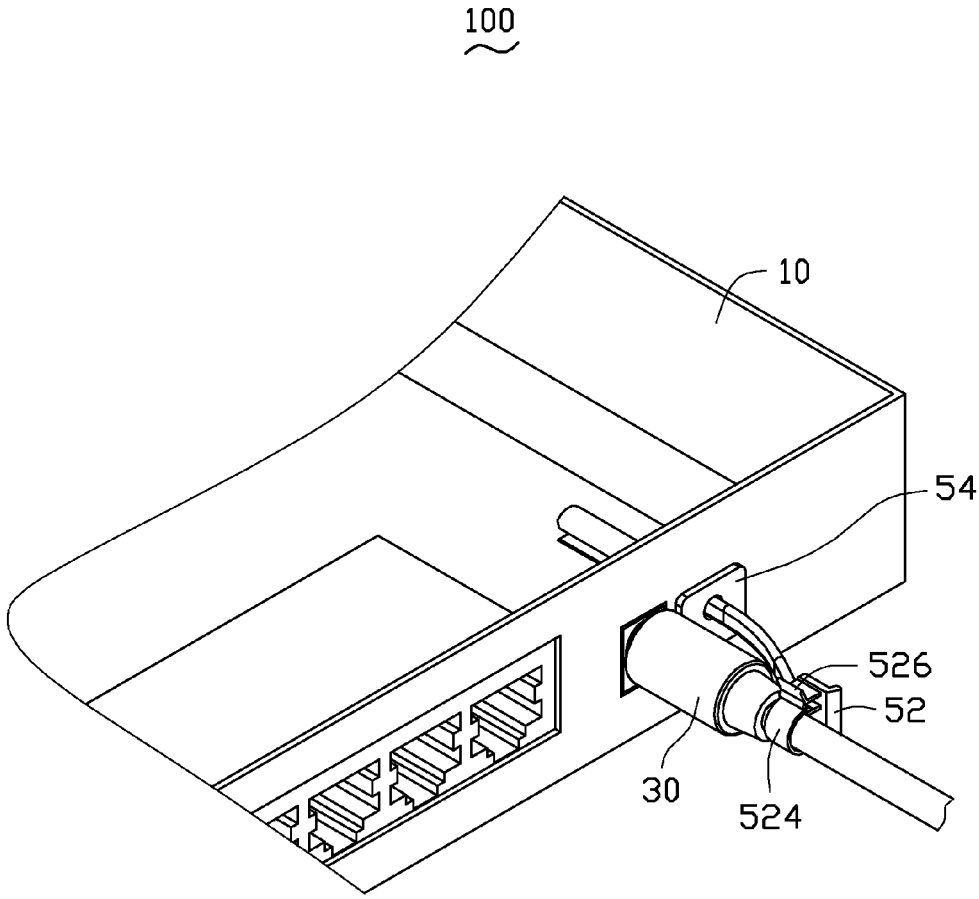
FIG. 5 is an assembled perspective view of the electronic device with locking assembly of FIG. 1, where the plug is in a locked position.

In FIG. 4 and FIG. 5, the plug 30 is locked by being collared in the loop 524 of the locking portion 52 and the clasp 526 is clasped to the second hook 5240 to secure and lock the plug 30 to the case 10. Thus, plug 30 is thus attached to the socket 120 more firmly even if an unexpected pull occurs on the cable of the plug 30, and the power supply is thus secured.

In the locked position, the locking assembly 50 locks the plug 30 and the first hook 5220 of the securing arm 522 hooks over an inner wall of the slot 5420 to prevent the locking portion 52 disengaging from the locking portion seat 54.

In the unlocked position, the clasp 526 is pressed with a fingertip to disengage the second hook 5240 and the plug 30 may be removed from the loop 524.

In FIG. 3 and FIG. 6, in the unlocked position, the first hook 5220 of the securing arm 522 is passed through the locking portion sleeve 542 and the flange portion 5222 abuts the inner wall of the slot 5420 which is adjacent to the locking portion seat 540, the locking portion 52 is then in a stored position. In another embodiment, the first hook 5220 of the securing arm 522 hooks over the distal end of the locking portion sleeve 542 to locate the locking portion 52 in the stored position without the flange portion 5222.

The foregoing disclosure of the various embodiments has been presented for purposes of illustration and description. It is not intended to be exhaustive or to limit the disclosure to the precise forms disclosed. Many variations and modifications of the embodiments described herein will be apparent to one of ordinary skill in the art in the light of the above disclosure. The scope of the disclosure is to be defined only by the claims appended hereto and their equivalents.

What is claimed is:

1. An electronic device, comprising:

a case comprising a sidewall that comprises an socket and defines a receiving hole;

a plug inserted into the socket; and a locking assembly comprising:

a locking portion seat mounted to the receiving hole of the sidewall; the locking portion comprising a base, a locking portion sleeve and defining a through hole, wherein the locking portion sleeve extends from the base and is received in the receiving hole, and the through hole runs through the base and the locking portion sleeve; and a locking portion comprising a securing arm, a loop and a clasp, wherein the securing arm is inserted into the through hole to attach the locking portion and the locking portion seat, the an end of the loop comprises a first hook;

wherein the clasp buckles to the first hook to clasp the plug accommodated in the loop to the socket of the case.

2. The electronic device of claim 1, wherein the locking portion further comprises a main body, wherein the securing arm extends from a first surface of the main body to the locking portion seat, both the loop and the clasp dispose on a second surface of the main body.

3. The electronic device of claim 2, wherein the securing arm comprises a second hook located to a tail of the securing arm.

4. The electronic device of claim 3, wherein the locking portion sleeve defines a slot communicated with the through hole.

5. The electronic device of claim 3, wherein the second hook moves along the slot to make the securing arm of the locking portion move relative to the locking portion sleeve.

6. The electronic device of claim 2, wherein the main body comprises a stopper portion located into the inside wall of the clasp to prevent the first hook of the loop disengaging from the clasp with the clasp.

7. The electronic device of claim 1, wherein the locking portion seat further comprises a pair of buckle portion, each of the buckle portion extended from the base and located to the edge of the locking portion sleeve.

8. The electronic device of claim 7, wherein each of the buckle portion received to the receiving hole comprises a third hook to clasp the locking portion seat to the sidewall.

* * * * *